US008897996B2

(12) United States Patent
Massaro

(10) Patent No.: US 8,897,996 B2
(45) Date of Patent: Nov. 25, 2014

(54) METHOD FOR DIAGNOSING A CLOGGING OF AN INJECTOR IN AN INTERNAL COMBUSTION ENGINE

(75) Inventor: Antonio Massaro, Turin (IT)

(73) Assignee: GM Global Technology Operations LLC, Detroit, MI (US)

( * ) Notice: Subject to any disclaimer, the term of this patent is extended or adjusted under 35 U.S.C. 154(b) by 441 days.

(21) Appl. No.: 13/316,623

(22) Filed: Dec. 12, 2011

(65) Prior Publication Data

US 2012/0150417 A1 Jun. 14, 2012

(30) Foreign Application Priority Data

Dec. 13, 2010 (GB) ..... 1021073.0

(51) Int. Cl.

| | |
|---|---|
| ***F02M 65/00*** | (2006.01) |
| ***F02D 41/38*** | (2006.01) |
| ***F02D 41/22*** | (2006.01) |
| *F02M 51/00* | (2006.01) |
| *F02D 41/24* | (2006.01) |

(52) U.S. Cl.

CPC ..... *F02D 41/222* (2013.01); *F02D 41/3809* (2013.01); *F02D 41/2438* (2013.01); *F02D 2200/0602* (2013.01)

USPC ..... 701/114; 123/198 D

(58) Field of Classification Search

USPC ..... 701/102, 104, 114; 123/478, 456, 123/198 D; 73/114.43, 114.51

See application file for complete search history.

(56) References Cited

U.S. PATENT DOCUMENTS

| | | | | |
|---|---|---|---|---|
| 5,241,933 | A * | 9/1993 | Morikawa | 123/198 D |
| 5,445,019 | A * | 8/1995 | Glidewell et al. | 73/114.51 |
| 5,535,621 | A | 7/1996 | Glidewell et al. | |
| 5,633,458 | A * | 5/1997 | Pauli et al. | 73/114.51 |
| 2003/0226399 | A1 * | 12/2003 | Clingerman et al. | 73/119 A |
| 2010/0010726 | A1 * | 1/2010 | Orikabe | 701/103 |

FOREIGN PATENT DOCUMENTS

| | | | |
|---|---|---|---|
| DE | 102004029454 | A1 | 3/2005 |
| EP | 0860600 | A2 | 8/1998 |
| EP | 1036923 | A2 | 9/2000 |
| JP | 10238391 | A | 9/1998 |
| JP | 2004084538 | A | 3/2004 |
| JP | 2005344521 | A | 12/2005 |

* cited by examiner

*Primary Examiner* — Mahmoud Gimie

(74) *Attorney, Agent, or Firm* — Ingrassia Fisher & Lorenz, P.C.

(57) ABSTRACT

A method is provided for diagnosing a clogging of an injector in an internal combustion engine equipped with a fuel rail and with a plurality of fuel injectors hydraulically connected to the fuel rail. The method includes, but is not limited to determining a value of a pressure drop in the fuel rail due to a quantity of fuel injected by a tested injector, and diagnosing the clogging of the tested injector if the determined pressure drop value is lower than a threshold value of this pressure drop.

20 Claims, 6 Drawing Sheets

METHOD FOR DIAGNOSING A CLOGGING OF AN INJECTOR IN AN INTERNAL COMBUSTION ENGINE

CROSS-REFERENCE TO RELATED APPLICATION

This application claims priority to British Patent Application No. 1021073.0, filed Dec. 13, 2010, which is incorporated herein by reference in its entirety.

TECHNICAL FIELD

The technical field relates to a method for diagnosing a clogging of an injector in an internal combustion engine.

BACKGROUND

It is known that modern engines are provided with a fuel injection system for directly injecting the fuel into the cylinders of the engine. The fuel injection system generally comprises a fuel common rail, which is kept under high pressure by a high pressure pump and electrically controlled fuel injectors, which are individually located in a respective cylinder of the engine and are hydraulically connected to the fuel common rail through dedicated injection lines. Each fuel injector generally comprises a nozzle and a movable needle that repeatedly opens and closes this nozzle; fuel can thus be injected into the cylinder giving rise to single or multi-injection patterns at each engine cycle.

The needle is moved with the aid of a dedicated actuator, typically a solenoidal actuator or a piezoelectric actuator, which is controlled by an engine control unit (ECU). The ECU operates each fuel injection by generating an electric opening command, causing the actuator to open the fuel injector nozzle for a predetermined amount of time, and a subsequent electric closing command, causing the actuator to close the fuel injector nozzle. The time between the electric opening command and the electric closing command is generally referred as energizing time of the fuel injector, and it is determined by the ECU as a function of a desired quantity of fuel to be injected.

During normal use of the vehicle it may happen that the user notices some anomalies in the functioning of the engine, for example an excessively noisy engine or an engine that does not respond adequately to the driver's input, leading to drivability problems, namely to a degrading of the smoothness and steadiness of acceleration of an automotive vehicle or other undesired degradation of engine's performance such as excessive emissions. A possible cause of these phenomena is the clogging of one or more injector in the engine due, for example, to coking presence.

At least one object is to provide a test procedure that can be performed at a vehicle service center to verify if one or more injectors are clogged or partially clogged. At least a further object is to provide an injector clogging detection procedure while avoiding engine shutdown, even in case of big engines having a high number of cylinders. Yet still another object is to provide a procedure that can be used to identify a clogged injector for repair or substitution in order to avoid emission increase due to anomalous engine performance. At least another object is to provide such detection without using complex devices and by taking advantage from the computational capabilities of the Electronic Control Unit (ECU) of the vehicle. In addition, other objects, desirable features, and characteristics will become apparent from the subsequent summary and detailed description, and the appended claims, taken in conjunction with the accompanying drawings and this background.

SUMMARY

An embodiment provides for method for diagnosing a clogging of an injector in an internal combustion engine equipped with a fuel rail and with a plurality of fuel injectors hydraulically connected to the fuel rail, the method comprising: injecting a quantity of fuel by a tested injector (12A-H), determining a value of a pressure drop in the fuel rail (20) due to the fuel injection, and diagnosing the clogging of the tested injector (12A-H) if the determined pressure drop value is lower than a threshold value ($Th_1$, $Th_2$) of this pressure drop.

The first two steps will normally be carried out by the engine under the supervision of the ECU, as will be explained below in more detail. The steps will not be performed under normal driving conditions, but during an inspection of the vehicle by a technician in a garage. The third step can be carried out either by the engine or manually by the technician. In both cases, the measured pressure drop values are compared to stored values, which are ok, or to values that indicate clogging. In the first case, the result is stored in the ECU, normally by setting a flag indicating the clogging of an individual injector. In both cases, determining a clogging of an injector will serve as a suggestion to the technician to replace the clogged injector by a new one to avoid the anomalies due to clogging mentioned above. At least one advantage of this embodiment is that it allows detecting the clogging of an injector using a procedure that can be implemented using the engine and its systems, such as the associated sensors and the Electronic Control Unit of the engine.

According to a further embodiment, the method comprises the phases of: determining a value of a pressure drop in the fuel rail for each injector, each pressure drop value being due to a quantity of fuel injected by the related injector during the predetermined period, and determining the threshold value on the basis of the average of these pressure drop values. An advantage of this embodiment is that it allows performing a test on all the injectors, one by one, with a simple procedure.

According to a further embodiment, the method comprises the phases of: determining a value of a pressure drop in the fuel rail for each injector, each pressure drop value being due to a quantity of fuel injected by the related injector during the predetermined period, and determining the threshold value on the basis of the average of these pressure drop values except the pressure drop value related to the tested injector. An advantage of this embodiment is that it provides an alternative method to perform a test on all the injectors.

According to a further embodiment, the quantity of fuel injected by each injector during the predetermined period is achieved with a plurality of fuel injections performed by that injector. The related pressure drop value is determined as the sum of the values of pressure drop due to each of these fuel injections. An advantage of this embodiment is that allows a robust diagnostic method.

According to still another embodiment, the injections are performed with the engine in idle condition.

According to another embodiment, a predefined starting pressure of fuel in the common rail is set higher than the idle pressure value. An advantage of this embodiment is that it allows a suitable pressure starting point for performing the method and measure the resulting pressure drops.

According to another embodiment, the injections are performed with single injection pulse per engine cycle. An advantage of this embodiment is that it allows using standard injector working conditions for the actuation of the method According to a further embodiment, the detection is interrupted if a predefined minimum fuel pressure is reached. An advantage of this embodiment is that it avoids engine shutdown during the actuation of the method.

The method according to one of the embodiments can be carried out with the help of a computer program comprising a program-code for carrying out all the steps of the method described above, and in the form of computer program product comprising the computer program. The computer program can be also embodied as an electromagnetic signal, the signal being modulated to carry a sequence of data bits the represents a computer program to carry out all steps of the method.

The computer program may reside on or in a data carrier, e.g., a flash memory, which is data connected with said control apparatus for an internal combustion engine. The control apparatus has a microprocessor that receives computer readable instructions in form of parts of said computer program and executes them. Executing these instructions amounts to performing the steps of the method as described above, either wholly or in part.

The electronic control apparatus can be a dedicated piece of hardware such as the ECU, which is commercially available and thus known in the art, or can be an apparatus different from such an ECU, e.g., an embedded controller. If the computer program is embodied as an electromagnetic signal as described above, then the ECA, e.g., the ECU, has a receiver for receiving such a signal or is connected to such a receiver placed elsewhere. The signal may be transmitted by a programming robot in a manufacturing plant. The bit sequence carried by the signal is then extracted by a demodulator connected to the storage unit, after which the bit sequence is stored on or in said storage unit of the ECA.

A still further embodiment provides an internal combustion engine specially arranged for carrying out the method claimed.

Another embodiment relates to an apparatus for diagnosing a clogging of an injector in an internal combustion engine equipped with a fuel rail and with a plurality of fuel injectors hydraulically connected to the fuel rail, the apparatus comprising an injector for injecting a quantity of fuel by an injector to be tested, a determining apparatus for determining a value of a pressure drop in the fuel rail due to the fuel injection, and a diagnostic for diagnosing the clogging of the tested injector if the determined pressure drop value is lower than a threshold value ($Th_1$, $Th_2$) of this pressure drop. An advantage of this apparatus is that it allows detecting the clogging of an injector using a procedure that can be implemented using the engine and its systems, such as the associated sensors and the Electronic Control Unit of the engine.

An embodiment of the apparatus additionally has a determining apparatus for determining a value of a pressure drop in the fuel rail for each injector, each pressure drop value being due to a quantity of fuel injected by the related injector, and means for determining the threshold value on the basis of the average of these pressure drop values. An advantage of this embodiment is that it allows performing a test on all the injectors, one by one, with a simple procedure.

Still another embodiment of the apparatus has a determining apparatus for determining a value of a pressure drop in the fuel rail for each injector, each pressure drop value being due to a quantity of fuel injected by the related injector, and means for determining the threshold value on the basis of the average of these pressure drop values except the pressure drop value related to the tested injector. An advantage of this embodiment is that it provides an alternative method to perform a test on all the injectors.

A further embodiment of the apparatus is configured to achieve the quantity of fuel injected by each injector with a plurality of fuel injections performed by that injector, and is further configured to determine the related pressure drop value as the sum of the values of pressure drops due to each of these fuel injections. An advantage of this embodiment is that allows a robust diagnostic method.

Still another embodiment of the apparatus is configured to perform the injections with the engine in idle condition. An advantage of this embodiment is that it allows using standard engine condition for the actuation of the method.

A further embodiment of the apparatus has an injection apparatus that is configured to set a predefined starting pressure ($P_{start}$) of fuel in the common rail to a higher value than the idle pressure value. An advantage of this embodiment is that it allows a suitable pressure starting point for performing the method and measure the resulting pressure drops. The apparatus can additionally have an injection apparatus configured to the injections with single injection pulse per engine cycle.

Furthermore, an embodiment of the apparatus can have a detection apparatus configured to interrupt the detection if a predefined minimum fuel pressure ($P_{min}$) is reached. An advantage of this embodiment is that it avoids engine shutdown during the actuation of the method.

BRIEF DESCRIPTION OF THE DRAWINGS

The present invention will hereinafter be described in conjunction with the following drawing figures, wherein like numerals denote like elements, and.

DETAILED DESCRIPTION OF THE DRAWINGS

The following detailed description is merely exemplary in nature and is not intended to limit application and uses. Furthermore, there is no intention to be bound by any theory presented in the preceding background or summary or the following detailed description.

Figure 1:
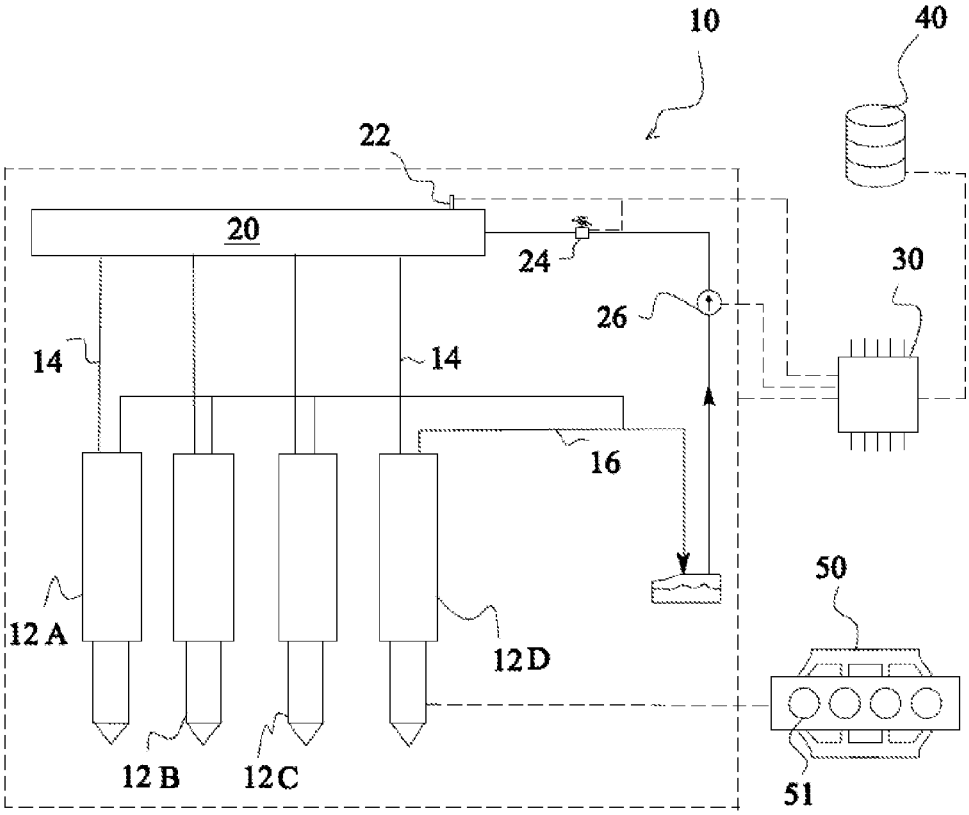
FIG. 1 is a schematic representation of a fuel injection system equipped with a fuel common rail suitable for the actuation of an embodiment.

In FIG. 1 a fuel injection system 10 for a four-cylinders internal combustion engine 50 is schematically represented, the system 10 comprising a plurality of injectors 12A-D, each injector 12A-D being connected with a high pressure injection line 14 to a common rail 20 which is kept under high pressure by an high pressure pump 26. Each injector 12A-D is suitable to inject a quantity of fuel into a respective cylinder 51 of the internal combustion engine 50. The fuel injection system 10 and the engine 50 are equipped with an Electronic control unit (ECU) 30; the ECU 30 is equipped with a data carrier 40 and is used to perform the method of the disclosure.

The opening of each injector 12A-D is controlled with a pilot valve (not represented) that is placed inside the injector 12A-D itself; when the injector 12A-D is acted upon by the pilot valve, a quantity of fuel is expelled outside the injector 12A-D through the pilot valve and flows through a leak line 16 that goes back to a fuel tank 60 to recover this fuel for future injections. Any injection causes a small pressure drop that can be measured by a pressure sensor 22. A pressure regulator 24, connected to the ECU 30 is used in closed loop to control the pressure in the common rail 20.

Figure 2:
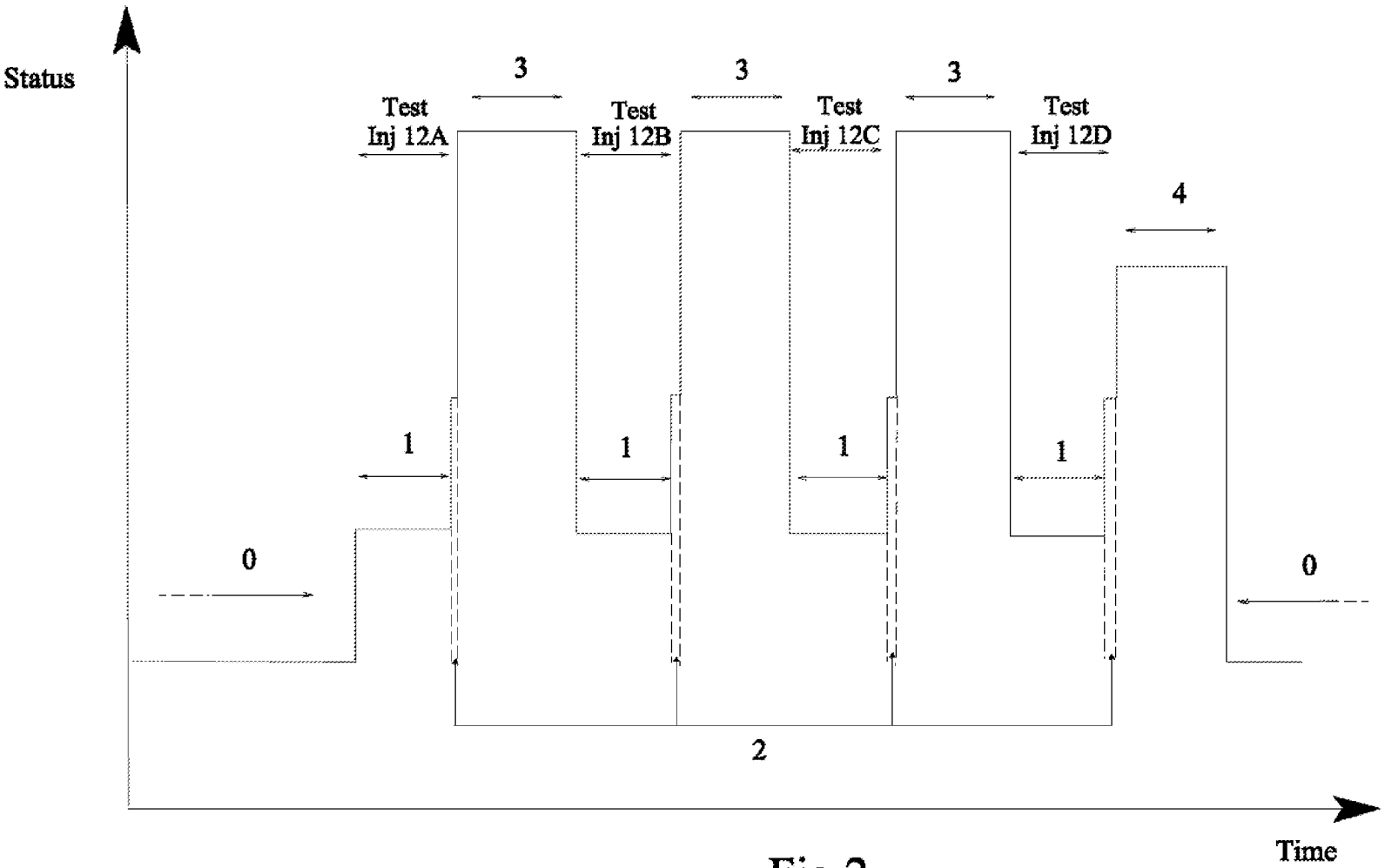
FIG. 2 is a schematic representation of the main steps of an embodiment of the method.

In the following disclosure, the expression clogged injector will indicate any malfunctioning injector regardless if the clogging is partial or total. In FIG. 2, a schematic representation of the main steps of an embodiment of the method of the invention is shown.

Specifically, in FIG. 2 five main phases of an embodiment of the method of the invention are represented, starting from an initialization Phase 0, in which the clogged injector detection is not yet active. In the next Phase 1, the engine 50 is set in an idle speed condition. In this condition, any injection pattern present in multi-injection engines 50 is changed, forcing only one injection pulse per engine cycle. Then a predefined common rail 20 pressure ($P_{start}$) set point is set and a predefined amount of time is waited until a stabilized value of this pressure set point is achieved in the common rail 20. The pressure set point ($P_{start}$) is higher than the typical idle pressure value.

Figure 3:
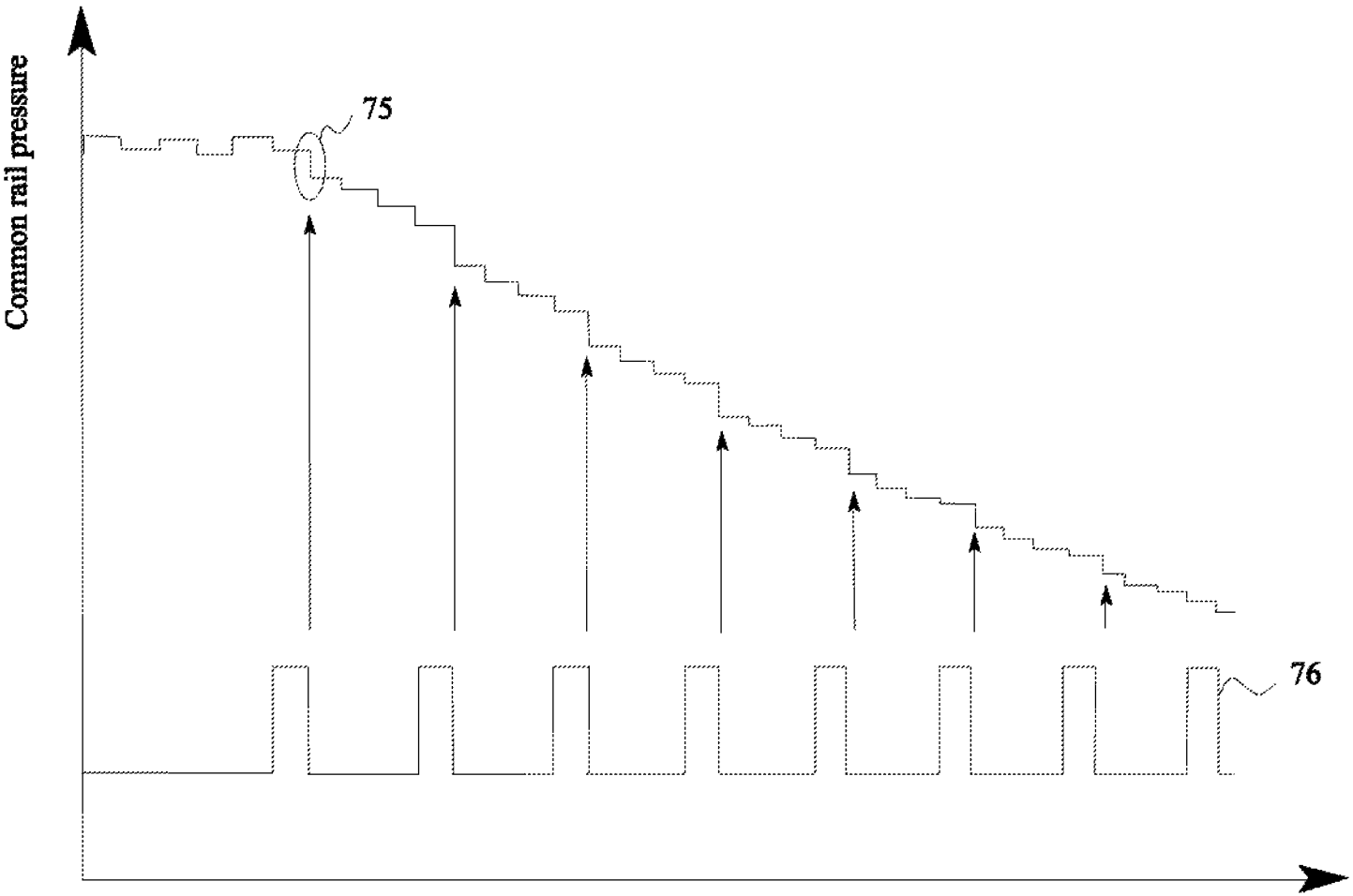
FIG. 3 is a graph depicting a cumulative pressure drop for each cylinder according to an embodiment of the method.

In Phase 2, the idle control is disabled and the high-pressure pump 26 control is disabled. In this condition, an injection pattern made by one pulse per engine cycle is repeated for a certain number of times, for each injector 12A-D, determining a common rail 20 pressure drop. Then common rail 20 pressure is sampled, evaluating pressure drops due to the activity of each injector 12A-D, and the cumulative pressure drops for each injector 12A-D are stored in data carrier 40. For example, in FIG. 3 a curve of activation 76 for an injector 12D is depicted and correlated with pressure drops 75 due to that injector 12D. The other pressure drops represent the activity of the other injectors.

In Phase 3, common rail pressure control is re-enabled and idle control is re-enabled and in Phase 4, the injection pattern is re-stored in case of multi-injection engines 50. When this embodiment of the method is completed, all cumulative pressure drops for each injector 12A-D are compared with one another and this comparison is used to identify a clogged injector 12D.

Figure 4:
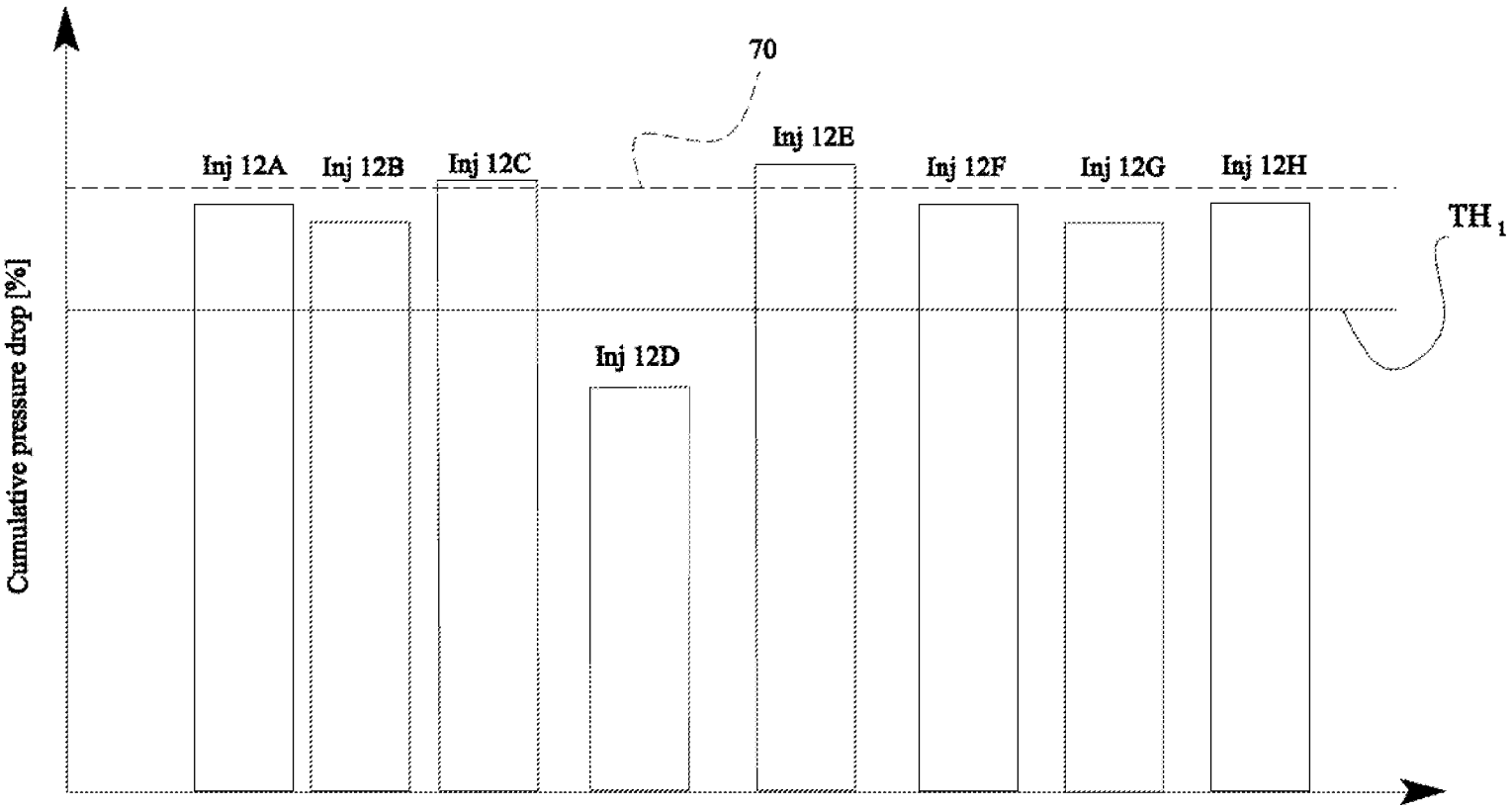
FIG. 4 is a graph depicting the pressure drop of several cylinders in an engine according to a first embodiment of the method.

The method can be actuated also for engines 50 having a high number of cylinders; for example, FIG. 4 illustrates a comparison of cumulative pressure drops for an eight-cylinder engine 50, having injectors 12A-H. In addition, in this case, to identify if an injector 12D is clogged, its cumulative pressure drop shall be lower than the average drops of the other injectors by a cumulative pressure drop threshold $TH_1$. A specific value for the cumulative pressure drop threshold $TH_1$ can be used in these cases. For example, if the cumulative pressure drop of an injector 12D is more than approximately 20% lower than the average injector cumulative pressure drop 70, that injector 12D can be identified as clogged.

Figure 5:
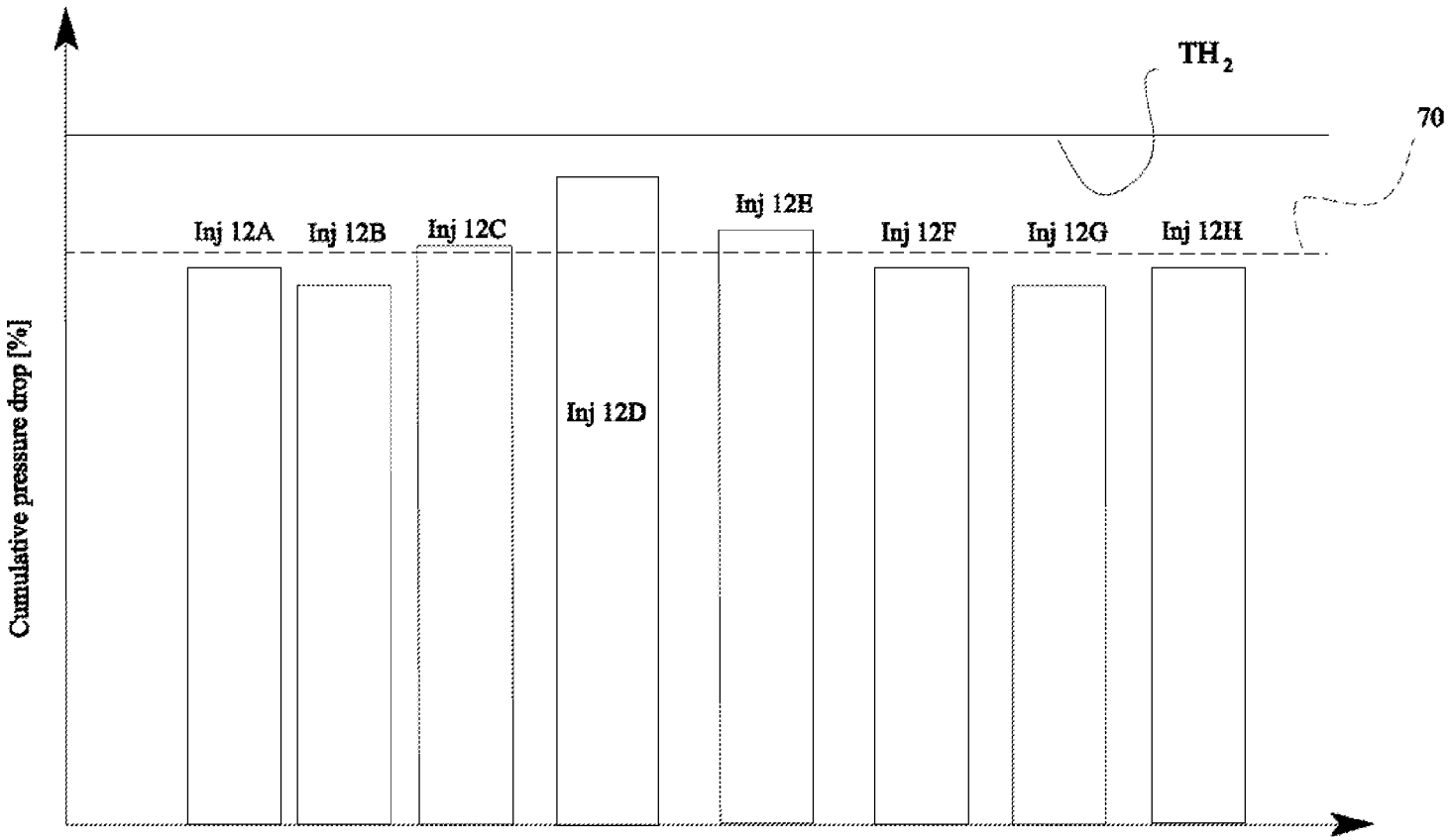
FIG. 5 is a graph depicting the pressure drop of several cylinders in an engine according to a second embodiment of the method.

An alternative embodiment of the method is actuated according to the following phases. Each injector 12A-D is tested one by one and for each injector 12A-D that is not tested a fixed energizing time (ET) and start of injection (SOI) for each injection are set. Then an energizing time ($ET_1$) greater than the energizing time of the injectors that are not tested is set for the injector 12D currently tested. At this point the cumulative pressure drops for the injectors are calculated and a clogging of the injector 12D currently tested can be detected, if the cumulative pressure drop for that injector 12D is lower than a predefined threshold $TH_2$ (FIG. 5), said threshold $TH_2$ being dependent on the difference between energizing times ET, $ET_1$ of the injectors 12A-H. The threshold $TH_2$ is set higher than the average cumulative pressure drops of the other injectors. On the contrary, if all injectors are working properly, namely no coking phenomena is present, the cumulative pressure drop for the injector 12D under evaluation is greater than the average cumulative pressure drop 70 of the other injectors 12A-D by the predefined threshold $TH_2$.

Alternatively, an energizing time ($ET_1$) lower than the energizing time of the injectors that are not tested can be set for the injector 12D currently tested. In this case (not represented for simplicity), a clogging of the injector 12D currently tested can be detected, if the cumulative pressure drop for that injector 12D is lower than the average cumulative pressure drop 70 of the other injectors by a predefined threshold $TH_2$. In this case, the threshold $TH_2$ is set lower than the average cumulative pressure drop 70 of the other injectors.

Figure 6:
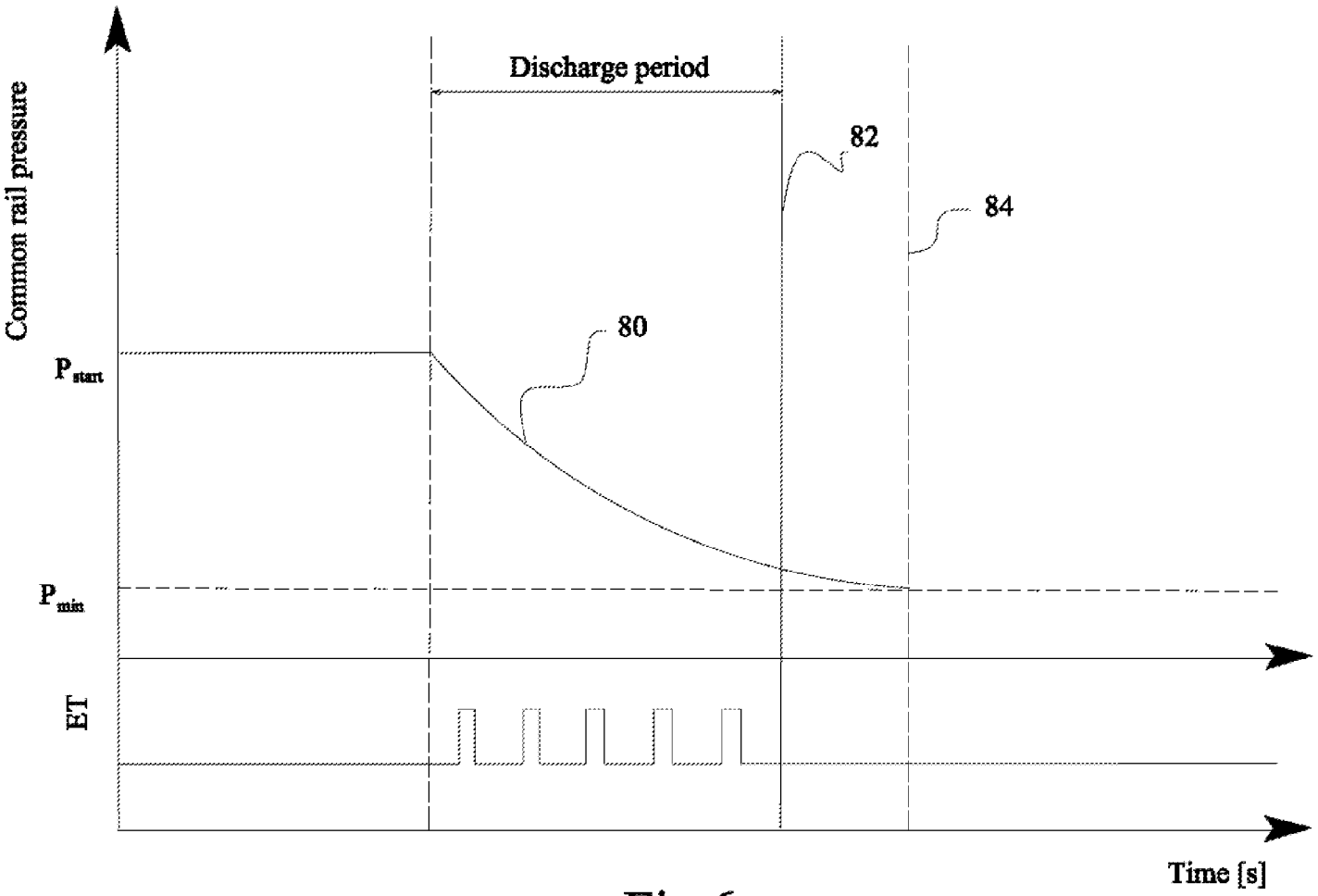
FIG. 6 is a graph depicting a completed injector test according to an embodiment of the method.

During Phase 2, the fact that a common rail pressure drop is generated by activity of the injector, might force engine 50 shutdown. In this case, engine 50 shutdown may be avoided by choosing a minimum fuel pressure ($P_{min}$) allowed by the engine 50 under test. This situation is exemplified in FIG. 6 were a pressure drop curve 80 is represented as generated by the test of one injector 12D. In this case the test ends (in 82) before the low-pressure limit 84, under which engine 50 shutdown may occur, is reached. Therefore common rail pressure during the actuation of method described must not fall below this minimum pressure ($P_{min}$). The described method may be repeated several times cumulating the pressure drop evaluated cylinder by cylinder and test-by-test in order get enough data for evaluation.

In the described embodiment of the method, a correlation between fuel pressure drop due to one or more injections and the injector performance is established as explained in the following disclosure. The above-explained embodiments of the method can advantageously be used in Diesel engines having single or multi-injections capability.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents.

What is claimed is:

1. A method for diagnosing a clogging of an injector in an internal combustion engine equipped with a fuel rail and with a plurality of fuel injectors hydraulically connected to the fuel rail, the method comprising:

injecting a quantity of fuel by a tested injector;

determining a value of a pressure drop in the fuel rail due to fuel injection;

diagnosing the clogging of the tested injector if the value of the pressure drop is lower than a threshold value of the pressure drop; and determining the value of the pressure drop in the fuel rail for each injector, each value of the pressure drop due to the quantity of fuel injected by a related injector; and determining the threshold value based at least in part on an average of values of the pressure drop.

2. The method according to claim 1, wherein the determining the threshold value comprises determining the threshold value based at least in part on an average of each value of the pressure drop.

3. The method according to claim 1, wherein the determining the threshold value comprises determining the threshold value based at least in part on an average of each value of the pressure drop except for the value of the pressure drop related to the tested injector.

4. A method for diagnosing a clogging of an injector in an internal combustion engine equipped with a fuel rail and with a plurality of fuel injectors hydraulically connected to the fuel rail, the method comprising:

injecting a quantity of fuel by a tested injector;

determining a value of a pressure drop in the fuel rail due to fuel injection; and diagnosing the clogging of the tested injector if the value of the pressure drop is lower than a threshold value of the pressure drop, wherein the quantity of fuel injected by each injector is achieved with a plurality of fuel injections performed by the injector, and wherein a value of a related pressure drop is determined as a sum of pressure drops due to each of the plurality of fuel injections.

5. The method according to claim 1, further comprising preforming the injecting with the internal combustion engine in idle condition.

6. The method according to claim 1, further comprising setting a predefined starting pressure of fuel in a common rail higher than an idle pressure value.

7. The method according to claim 1, further comprising performing the injecting with a single injection pulse per an engine cycle.

8. The method according to claim 1, further comprising interrupting the detecting if a predefined minimum fuel pressure is reached.

9. An internal combustion engine, comprising:

a fuel injection system equipped with a common rail;

a plurality of fuel injectors configured to receive a fuel quantity from injection lines;

a pressure sensor configured to measure pressure differences of the common rail; and an Electronic Control Unit configured to inject a quantity of fuel by a tested injector;

determine a value of a pressure drop in a fuel rail due to fuel injection;

diagnose the clogging of the tested injector if the value of the pressure drop is lower than a threshold value of the pressure drop;

determine the value of the pressure drop in the fuel rail for each injector, each value of the pressure drop due to the quantity of fuel injected by a related injector; and determine the threshold value based at least in part on an average of values of the pressure drop.

10. The internal combustion engine according to claim 9, wherein the Electronic Control Unit is further configured to:

determine the threshold value based at least in part on an average of each value of the pressure drop.

11. The internal combustion engine according to claim 9, wherein the Electronic Control Unit is further configured to:

determine the threshold value based at least in part on an average of each value of the pressure drop except for the value of the pressure drop related to the tested injector.

12. The internal combustion engine according to claim 9, wherein the quantity of fuel injected by each injector is achieved with a plurality of fuel injections performed by the injector, and wherein a value of a related pressure drop is determined as a sum of pressure drops due to each of the plurality of fuel injections.

13. The internal combustion engine according to claim 9, wherein the Electronic Control unit is further configured to performing the injecting with the internal combustion engine in idle condition.

14. The method according to claim 9, wherein the Electronic Control Unit is further configured to set a predefined starting pressure of fuel in the common rail higher than an idle pressure value.

15. A computer readable medium embodying a computer program product, the computer program product, comprising:

a diagnostic program that is configured to diagnose a clogging of an injector in an internal combustion engine equipped with a fuel rail and with a plurality of fuel injectors hydraulically connected to the fuel rail, the diagnostic program configured to:

inject a quantity of fuel by a tested injector;

determine a value of a pressure drop in the fuel rail due to fuel injection;

diagnose the clogging of the tested injector if the value of the pressure drop is lower than a threshold value of the pressure drop;

determine the value of the pressure drop in the fuel rail for each injector, each value of the pressure drop due to the quantity of fuel injected by a related injector; and determine the threshold value based at least in part on an average of values of the pressure drop.

16. The computer readable medium embodying the computer program product according to claim 15, comprising:

determine the threshold value based at least in part on an average of each value of the pressure drop.

17. The computer readable medium embodying the computer program product according to claim 15, comprising:

determine the threshold value based at least in part on an average of each value of the pressure drop except for the value of the pressure drop related to the tested injector.

18. The computer readable medium embodying the computer program product according to claim 15, wherein the quantity of fuel injected by each injector is achieved with a plurality of fuel injections performed by the injector, and wherein a related pressure drop value is determined as a sum of pressure drops due to each of the plurality of fuel injections.

19. The computer readable medium embodying the computer program product according to claim 15, the diagnostic program further configured to performing the injecting with the internal combustion engine in idle condition.

20. The computer readable medium embodying the computer program product according to claim 15, the diagnostic program further configured to set a predefined starting pressure of fuel in a common rail higher than an idle pressure value.

* * * * *